United States Patent [19]

MacManus

[11] 3,947,149

[45] Mar. 30, 1976

[54] SUBMERGED FUEL PUMP WITH BEVEL SIDED IMPELLER BLADES

[75] Inventor: Daniel C. MacManus, Owosso, Mich.

[73] Assignee: General Motors Corporation, Detroit, Mich.

[22] Filed: Nov. 1, 1974

[21] Appl. No.: 519,836

[52] U.S. Cl. ..... 415/213 T; 417/423 R

[51] Int. Cl.[2] ..... F04D 29/24

[58] Field of Search..... 415/53 T, 198 T, 199 T, 415/213 T; 417/423 R; 416/223, 237

[56] References Cited

UNITED STATES PATENTS

| | | | |
|---|---|---|---|
| 2,700,935 | 2/1955 | Teague | 417/409 |
| 2,989,004 | 6/1961 | Zeidler et al. | 416/223 |
| 3,418,991 | 12/1968 | Shultz et al. | 417/423 R |

*Primary Examiner*—Carlton R. Croyle
*Assistant Examiner*—O. T. Sessions
*Attorney, Agent, or Firm*—Robert M. Sigler

[57] ABSTRACT

In a peripheral fluid pump designed for operation submerged in a vehicle fuel tank and comprising an impeller raceway with an outer annular channel, appropriately placed stripper abutments and an inlet and outlet on opposite sides of the raceway in communication with the annular channel, an impeller in the raceway has a hub and a plurality of vanes projecting radially outward into the annular channel. Each vane has front and rear sides in the direction of impeller rotation which are parallel to the axis of impeller rotation, an inlet side adjacent the inlet side of the pump forming an acute angle with the front side and an outlet side adjacent the outlet side of the pump forming an acute angle with the rear side.

2 Claims, 4 Drawing Figures

SUBMERGED FUEL PUMP WITH BEVEL SIDED IMPELLER BLADES

BACKGROUND OF THE INVENTION

This invention relates generally to vehicle fuel pumps of the submerged type and particularly to peripheral pumps containing vaned rotating impellers adapted to be driven by electric motors.

Electrically driven submergible fuel pumps designed for operation in the vehicle fuel tank are well known for their decreased tendency to produce vapor lock, their dependability and the flexibility of a separate switchable power source, which enables engine operation to be automatically stopped in situations where great engine damage is threatened, such as loss of oil pressure. Of course, these advantages are not without their price; since the electric motor of such a pump is an additional element added to the vehicle fuel system which may occasionally fail.

Although the failure rate of such pumps has been quite low, improvements in the dependability or expected life of vehicle fuel pumps are always welcome, since the result of a failed vehicle fuel pump is generally an inoperable vehicle.

A more efficient fuel pump — that is, a pump that produces a greater fluid output flow at a given rotational speed — could be run at a lower speed, thus reducing wear in the pump and the electric motor for longer pump life and more dependable operation.

SUMMARY OF THE INVENTION

The pump of this invention includes an impeller having vanes whose axial sides are beveled so that a cross section of the vane forms a parallelogram with the axial side of the inlet side of the pump forming an acute angle with the front side in the direction of pump rotation and the axial side on the outlet side of the pump forming an acute angle with the rear side. The beveled blade sides have been found to contribute to greater flow efficiency through the pump and result in a greater pump output at a given rotational speed.

Further details and advantages of this invention will be apparent from the accompanying drawings and following description of the preferred embodiment.

DESCRIPTION OF THE PREFERRED EMBODIMENT

Figure 1:
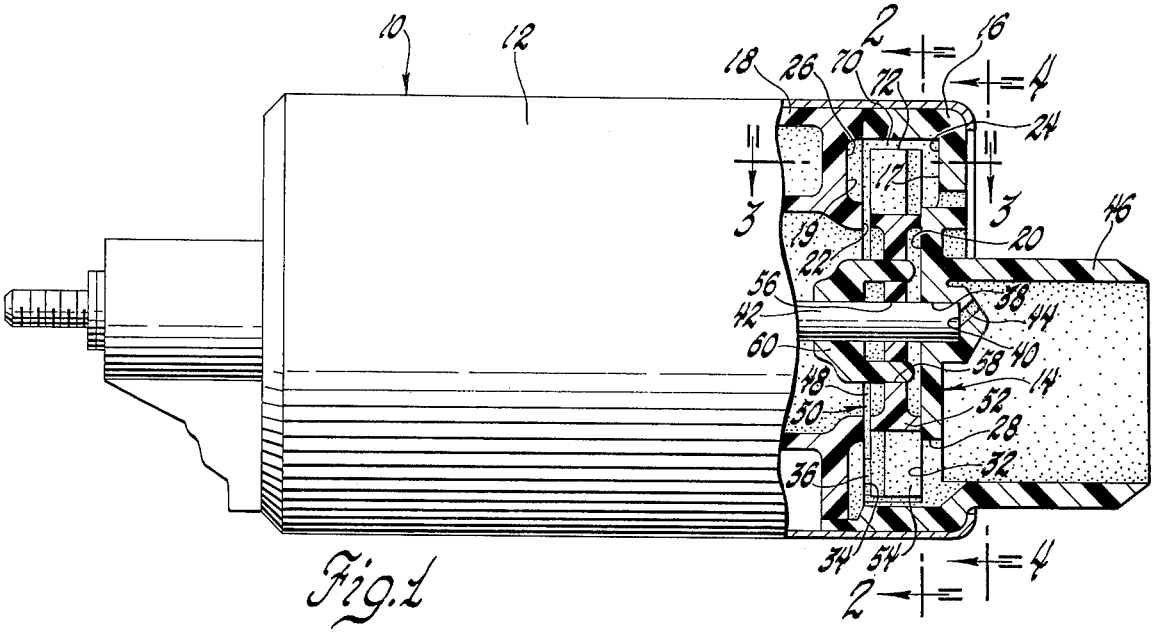
FIG. 1 shows a submergible fuel pump according to this invention partially cut away to show the peripheral pump.

Referring to FIG. 1, a submergible electrically driven fuel pump 10 of the type shown in the U.S. Patent to Shultz et al. No. 3,418,991 dated Dec. 31, 1968, hereby incorporated by reference, includes a cylindrical housing 12 which contains at one axial end, a peripheral pump, generally denoted as 14. Peripheral pump 14 comprises a cylindrical casing 16 and a cover 18, both preferably formed of a synthetic resin material such as fiberglass reinforced acetal resin. Casing 16 and cover 18 together respectively have confronting spaced-apart side walls 17 and 19 defining lateral surfaces or annular lands 20 and 22 and outwardly extending annular channels 24 and 26, respectively. Casing 16 has an inlet port 28 communicating with its annular channel 24, while cover 18 has an outlet port 30 communicating with its annular channel 26. These ports 28 and 30 are separated from each other by side stripper abutments 32 and 34, respectively in the casing 16 and cover 18, and a peripheral stripper abutment 36 in casing 16. Side stripper abutments 32 and 34 are extensions of lateral surfaces 20 and 22, respectively, and therefore are spaced apart the same lateral distance to effect fluid isolation for a seal between inlet and outlet ports 28 and 30 during operation of pump 14.

Casing 16 is provided with a center bearing bore 38 that terminates in a bearing seat 40. Bore 38 provides a journal support for the end of an armature shaft 42 of an electric motor, not shown, within cylindrical housing 12 which provides rotary power to pump 14. Bearing seat 40 includes a bleed hole 44 which exhausts to a tubular shaped extension 46 of casing 16 a small amount of leakage fuel that passes between the armature shaft 42 and bore 38 to provide bearing cleansing and lubrication. Tubular shaped extension 46, which communicates with inlet port 28, provides an inlet storage area for incoming fuel and a mounting for a filter element, not shown, to clean the fuel as described more completely in the reference patent.

Lateral surfaces 20 and 22 define therebetween a raceway 48 which has revolvably positioned therein an impeller 50, which may be made of the same material as casing 16 and cover 18 or of an easily die-casted metal such as aluminum. Impeller 50 includes a hub 52 that has substantially the same outer diameter as the inner diameter of annular channels 24 and 26. Extending radially outward from hub 52 are a series of vanes 54 which have random but carefully selected variable spacings and which are disconnected from each other so that crossflow of fuel can take place between the individual vanes 54. The random disposition of the vanes reduces pump noise.

Figure 2:
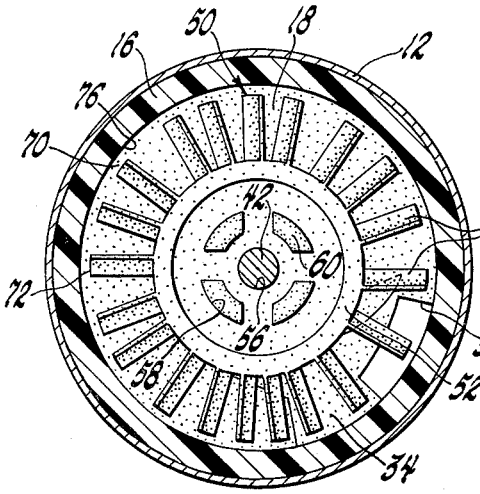
FIG. 2 is a cutaway view along line 2—2 in FIG. 1.

Impeller hub 52 has a center opening 56 with slightly rounded or tapered edges for easy insertion of the end of armature shaft 42 and a series of slots 58 spaced as shown in FIG. 2 about opening 56 for reception of a driver element 60 afixed to armature shaft 42, as shown in FIG. 1. Driver element 60 causes impeller 50 to turn with armature shaft 42; but the loose connection allows for slight variations resulting from manufacturing tolerances.

Figure 3:
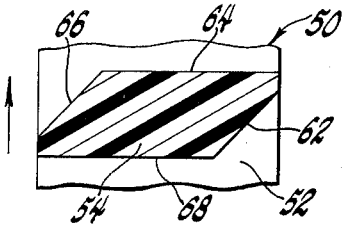
FIG. 3 is a cutaway view along line 3—3 in FIG. 1.
Figure 4:
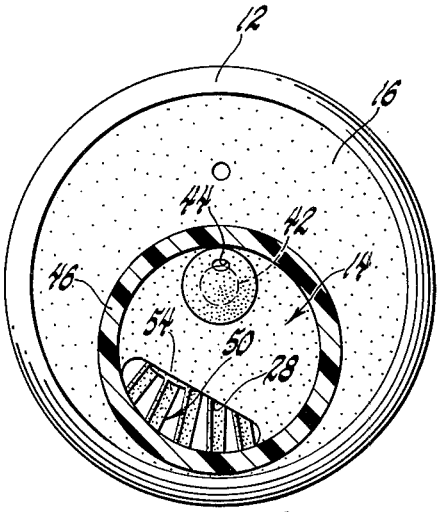
FIG. 4 is a cutaway view along line 4—4 in FIG. 1.

As can be seen in FIG. 3, a cross section of a vane 54 forms the shape of a parallelogram. Vane 54 has an inlet side 62 on the axial side of the impeller 50 adjacent inlet port 28 which forms an acute angle with front side 64 of vane 54 in the direction of vane rotation. Likewise, vane 54 has an outlet side 66 on the axial side of impeller 50 adjacent outlet port 30 which forms an acute angle with the rear side 68 of vane 54 in the direction of impeller rotation. Front side 64 and rear side 68 are parallel to each other and to the axis of rotation of impeller 50. Inlet side 62 and outlet side 66 are preferably, though not necessarily, parallel to one another; and the acute angle that they form with front side 64 and rear side 68, respectively, is, in this embodiment, 45°, although the invention is not to be construed as limited to that angle only. The parallel inlet and outlet sides 62 and 66 provide an additional advantage in that, in pump assembly, impeller 50 cannot be inserted backward.

In operation, impeller 50, in passing over inlet port 28, creates a suction that initiates fuel flow into the spaces between impeller vanes 54 from the inlet tubular extension 46. Due to centrifugal force the fuel is moved outwardly into an annular peripheral channel 70 defined between the peripheral edges 72 of the vanes 54 and the outer diameter 76 of the annular channels 24 and 26. The continuing force thereon causes the fuel to move into channels 24 and 26 inwardly toward the impeller hub at the same time it is advancing peripherally in the direction of impeller rotation at a speed slower than that of the impeller 50. It competes successfully with other fuel to re-enter the space between the impeller vanes 54 where centrifugal force again increases the energy of this fuel. Since the fuel is retained by the relatively close fits, it recirculates and spirals around the impeller 50. As impeller 50 continues to rotate, the fuel is acted upon several times and, therefore, acquires more energy than would be imparted to it by an equivalent size centrifugal pump. This results in a desired greater pressure than that attained in an equivalent centrifugal pump. Due to this increased energy, the fuel has its pressure progressively and continuously increased as it proceeds from the inlet port 28 to outlet port 30.

As impeller 50 passes over outlet port 30, the fuel in annular channel 26, as well as some of that in annular peripheral channels 70 and between vanes 54, is pushed out through outlet port 30.

It has been found that the angled inlet and outlet sides 62 and 66 of vanes 54 increase the fluid output of the pump through outlet port 30 at a given rotational speed of impeller 50. It is believed that the angled inlet side 62 contributes to this by creating a larger area between inlet side 62 of one vane 54 and front side 64 of the following vane into which fuel can flow and that angled outlet side 66 contributes to this effect by imparting a direct component of axial momentum to some of the fuel in the direction of outlet port 30.

The impeller 50 of this invention, in which front side 64 and rear side 68 of vanes 54 are parallel to the axis of impeller rotation and only inlet and outlet sides 62 and 66 are slanted, should be differentiated from an impeller in which the front and rear sides 64 and 68 are themselves slanted with respect to the axis of impeller rotation. The cross-sectional shape of the vanes of this invention is a relatively thick, stubby, strong vane which nevertheless produces the benefits of the invention. On the other hand, slanted vanes would have to be made considerably thinner than the typical 0.05 - 0.06 inch width between front and rear sides 64 and 68 of the impeller vanes 54 or the flow space between blades would become smaller and more constricted. Such thinner slanted blades would not have the strength of the vanes 54 of this invention and might be subject to an increased rate of failure which would cancel the very advantages sought.

The embodiment of this invention as described above is a preferred embodiment, but equivalents will occur to those skilled in the art. Therefor, the scope of this invention should be limited only by the claim which follows.

The embodiments of the invention in which are exclusive property or privelege is claimed are defined as follows:

1. A peripheral fuel pump assembly comprising, in combination:

a casing having confronting spaced-apart sidewalls defining an impeller raceway with an outer annular channel and having confronting side and peripheral stripper abutments in the annular channel and inlet and outlet ports positioned one in each sidewall adjacent to and on opposite sides of the side and peripheral stripper abutments and communicating with the annular channel; and an impeller revolvable in the raceway, the impeller having a hub and a series of vanes radially extending from the hub into the annular channel in peripherally spaced relationship to allow lateral fluid flow therebetween, each vane having front and rear sides in the direction of impeller rotation parallel to the impeller rotational axis, an axial outlet side forming a first acute angle with the rear side, which first acute angle is of such substantial size that the axial outlet side imparts to the fuel a substantial axial component of momentum toward the outlet, and an inlet side forming a second acute angle with the front side, the angled inlet side providing greater entrance area for fuel between the vanes, the second acute angle being equal in size to the first.

2. The peripheral fuel pump assembly of claim 1 in which the first and second acute angles are approximately 45°.

* * * * *